US010455920B2

(12) United States Patent
Meranus

(10) Patent No.: US 10,455,920 B2
(45) Date of Patent: Oct. 29, 2019

(54) PERSONAL PRODUCT APPLICATOR AND DISPENSER

(71) Applicant: Margaret Spicer Meranus, Cincinnati, OH (US)

(72) Inventor: Margaret Spicer Meranus, Cincinnati, OH (US)

( * ) Notice: Subject to any disclaimer, the term of this patent is extended or adjusted under 35 U.S.C. 154(b) by 0 days.

(21) Appl. No.: 16/180,329

(22) Filed: Nov. 5, 2018

(65) Prior Publication Data

US 2019/0281952 A1 Sep. 19, 2019

Related U.S. Application Data

(60) Provisional application No. 62/642,976, filed on Mar. 14, 2018, provisional application No. 62/719,448, filed on Aug. 17, 2018.

(51) Int. Cl.

| | |
|---|---|
| ***A45D 40/24*** | (2006.01) |
| ***A45D 34/06*** | (2006.01) |
| ***A45D 34/04*** | (2006.01) |
| *A45D 34/00* | (2006.01) |
| *A45D 40/00* | (2006.01) |

(52) U.S. Cl.

CPC ..... *A45D 34/06* (2013.01); *A45D 34/042* (2013.01); *A45D 40/24* (2013.01); *A45D 2034/005* (2013.01); *A45D 2040/0031* (2013.01)

(58) Field of Classification Search

CPC ..... A45D 34/00; A45D 34/06; A45D 34/042; A45D 2034/005; A45D 40/0068; A45D 40/18; A45D 40/205; A45D 40/24; A45D 2040/0031; B65D 21/0028; B65D 21/0233

USPC ..... 220/4.26, 4.27; 206/509

See application file for complete search history.

(56) References Cited

U.S. PATENT DOCUMENTS

| | | | | |
|---|---|---|---|---|
| 4,884,913 | A | 12/1989 | Smith et al. | |
| 2004/0052568 | A1 * | 3/2004 | Gueret | A45D 34/06 401/124 |
| 2010/0065576 | A1 | 3/2010 | Verheij | |

(Continued)

FOREIGN PATENT DOCUMENTS

| | | | |
|---|---|---|---|
| EP | 1050232 | A2 | 11/2001 |

OTHER PUBLICATIONS

Roger Riggle Make Up, LLC, Ben Nye stacks, www.rogerriggle.com/?product=ben-nye-fx-stack-5-colors, Ben Nye FX Palettes and Stacks (5 colors), captured (snipped) from web page (6 pages) (2017).

(Continued)

*Primary Examiner* — Rachel R Steitz

(74) *Attorney, Agent, or Firm* — Daniel F. Nesbitt; Hasse & Nesbitt LLC

(57) ABSTRACT

A personal care product applicator comprises a plurality of cartridge assemblies arranged in series along a common axis, wherein each cartridge assembly include a cartridge holder comprising a body that includes a cylindrical wall with an axial length, an attaching means proximate a top of the body, an upper securement and a lower securement, for securing the plurality of cartridge assemblies in series. and a cartridge including a base, a volume of personal care composition applied to an upper surface of the base, and an attaching member, configured for attaching the cartridge to the attaching means of the cartridge holder.

20 Claims, 14 Drawing Sheets

(56) References Cited

U.S. PATENT DOCUMENTS

| | | | | |
|---|---|---|---|---|
| 2011/0056866 | A1* | 3/2011 | Thiebault | A45D 33/26 206/581 |
| 2015/0216285 | A1* | 8/2015 | Grainger | A45D 40/18 206/581 |

OTHER PUBLICATIONS

Beauty Gala by Rebecca Kazimir, Melt Cosmetics "Love Sick" Eyeshadow Stack Swatches, Review & Look, www.beautygala.com/brands/melt-cosmetics-love-sick-eyeshadow-stack-swatches-review-look, from the Internet Archive Wayback Machine, Aug. 27, 2015, (19 pages).

* cited by examiner

PERSONAL PRODUCT APPLICATOR AND DISPENSER

CROSS-REFERENCE TO RELATED APPLICATIONS

This application claims the benefit of U.S. Provisional Application No. 62/642,976 filed Mar. 14, 2018, and also claims the benefit of U.S. Provisional Application No. 62/719,448 filed Aug. 17, 2018, the disclosures of which are incorporated herein by reference in their entireties.

BACKGROUND OF THE INVENTION

Personal care compositions including skin and lip care products, particularly lip balm, lip stick and lip gloss, are widely used by many people. Most of the applicator containers for these products are available as a single unit that is discarded once the personal care composition is used up completely or is contaminated. These applicator containers also restrict the usage to a single user and the variety of personal care compositions available in a single applicator container.

SUMMARY OF THE INVENTION

The present invention relates to the personal care product applicator container, useful for providing a personal care composition, The personal care product applicator container can comprise a cartridge assembly, the cartridge assembly including a cartridge holder and a cartridge, wherein the cartridge can include a product cartridge that further comprising a volume of personal care composition. The cartridge assembly is an independent unit, which can be refilled, or replaced, or discarded, without having to discard the entire personal care applicator container. Refilling is done by inserting a new product cartridge in place of an expended product cartridge.

The personal care product applicator container can also comprise a plurality of cartridge assemblies arranged in series along a common axis with each cartridge assembly including a cartridge holder and a cartridge, wherein the cartridge can include a product cartridge that further comprises a volume of personal care composition. Each cartridge assembly is an independent unit, which can be refilled, replaced, put in a different order relative to the other cartridge assemblies, or discarded separately without having to discard the entire personal care applicator container. Refilling is done by inserting a new product cartridge in place of an expended product cartridge.

The cartridge holder can comprise a body that includes a cylindrical wall with a length, an attaching means proximate a top of the body, an upper securement, and a lower securement, for securing the plurality of cartridge assemblies in series. A cartridge can include a base, and an attaching member, and a product cartridge can include the cartridge that further includes a volume of personal care composition, applied to an upper surface of the base, wherein the attaching member is configured for attaching the cartridge to the attaching means of the cartridge holder.

In an embodiment, the attaching member consists of a plug that includes a wall of cylindrical length with a bottom surface which extends from a lower surface of the base. The base and the plug can have a cylindrical bore extending axially there through, serving as a vent between the upper surface of the base and the bottom surface of the plug.

In a further embodiment, the body of the cartridge holder has an enlarged cavity extending into the body from an opening in a bottom of the body, the cavity being sufficient to receive a base and a volume of personal care composition of a serially-lower cartridge assembly.

In a further embodiment, the cartridge holder has a neck extending from the top of the cartridge holder, the neck having a cylindrical wall, and wherein the attaching means consists of an axial bore in the neck extending axially into the body, configured to receive the plug.

In a further embodiment, a lower securement of a cartridge holder of a serially-upper cartridge assembly can be positioned to engage an upper securement of a cartridge holder of a serially-lower cartridge assembly. At an engaged position, the serially-upper cartridge assembly is configured to be movable rotatively relative to the serially-lower cartridge assembly between an unsecured position where the serially-upper cartridge assembly and the serially-lower cartridge assembly can be axially separated, and a secured position where the serially-upper cartridge assembly and the serially-lower cartridge assembly are secured together.

In one embodiment, the upper and lower securements of the two serially-engageable cartridge holders comprise a means for securing the upper cartridge holder to the lower cartridge holder. Typical, the upper and lower securements are mating or matching elements. Non-limiting examples of the upper and lower securements comprise mating helical threads, a bayonet and a corresponding slot, an annular raised rib and a corresponding annular groove or annular raised rib; magnetic and mating ferro/magnetic connectors; and combinations thereof.

In one embodiment, the upper securement comprises a helical thread on an outside of the cylindrical wall of the neck and wherein the lower securement comprises a helical thread on an interior surface of the cylindrical wall of the cartridge holder which threadedly mates with the helical thread of the neck of a serially-lower cartridge holder.

In another embodiment, the upper securement comprises one or more bayonet that extends axially with a tab at a distal end, and the lower securement comprises one or more slot that engages with the one or more bayonet where the bayonet engages an axial portion of the slot when the upper cartridge holder is placed against the lower cartridge holder, and then locks with the bayonet where the bayonet engages a circumferential portion of the slot when the upper cartridge holder is rotated relative to the lower cartridge holder. Non-limiting example of a bayonet and slot securement is illustrated in U.S. Pat. Nos. 2,969,142, 5,443,175, 6,315,167, 7,618,208, 9,622,565 and 9,776,772, the disclosures of which are incorporated by reference in their entirety.

In another embodiment, the upper and lower securements of the two serially-engageable cartridge holders comprise magnetic and mating ferro/magnetic connectors, as described and illustrated in U.S. Pat. Nos. 8,821,057 and 8,556,527, the disclosures of which are incorporated by reference in their entirety.

In a further embodiment, the cartridge holder include a first locking member proximate the top of the cartridge holder of the serially-lower cartridge assembly, and a second locking member proximate the bottom of the cartridge holder of the serially-upper cartridge assembly, and the first locking member of the serially-lower cartridge assembly engages the second locking member of the serially-upper cartridge assembly to lock the serially-upper cartridge assembly and the serially-lower cartridge assembly at a lock position.

In another embodiment, one of the first locking member or the second locking member includes a detent and the other of the first locking member or the second locking member includes a locking protrusion that engages the detent at the locked position, to hold or lock the serially-upper cartridge assembly.

The personal care product applicator also includes a removable closure on an uppermost cartridge assembly, which comprises (a) a lower securement to engage an upper securement of the upper-most cartridge assembly, wherein the removable closure is movable relative to the upper-most cartridge assembly between an unsecured position and a secured position, and optionally (b) a locking member to lock the secured position of the removable closure with the upper-most cartridge assembly.

In a further embodiment, the lower securement of the removable closure comprises a helical thread that is configured to engage a mating helical thread of a neck of the upper-most cartridge assembly, to secure the removable closure and the upper most cartridge assembly at the secured position. Further, a locking member proximate the lower securement of the removable closure can comprise a locking member to engage a mating locking member of a neck of the upper-most cartridge assembly. The locking member and the mating locking member can be selected from a detent and a mating protruding tooth.

BRIEF DESCRIPTION OF THE FIGURES

The embodiment, aspects and advantages of the invention other than those set forth above will become apparent when consideration is given to the following detailed description thereof. Such description makes reference to the annexed drawings.

DETAILED DESCRIPTION OF THE INVENTION

Figure 1:
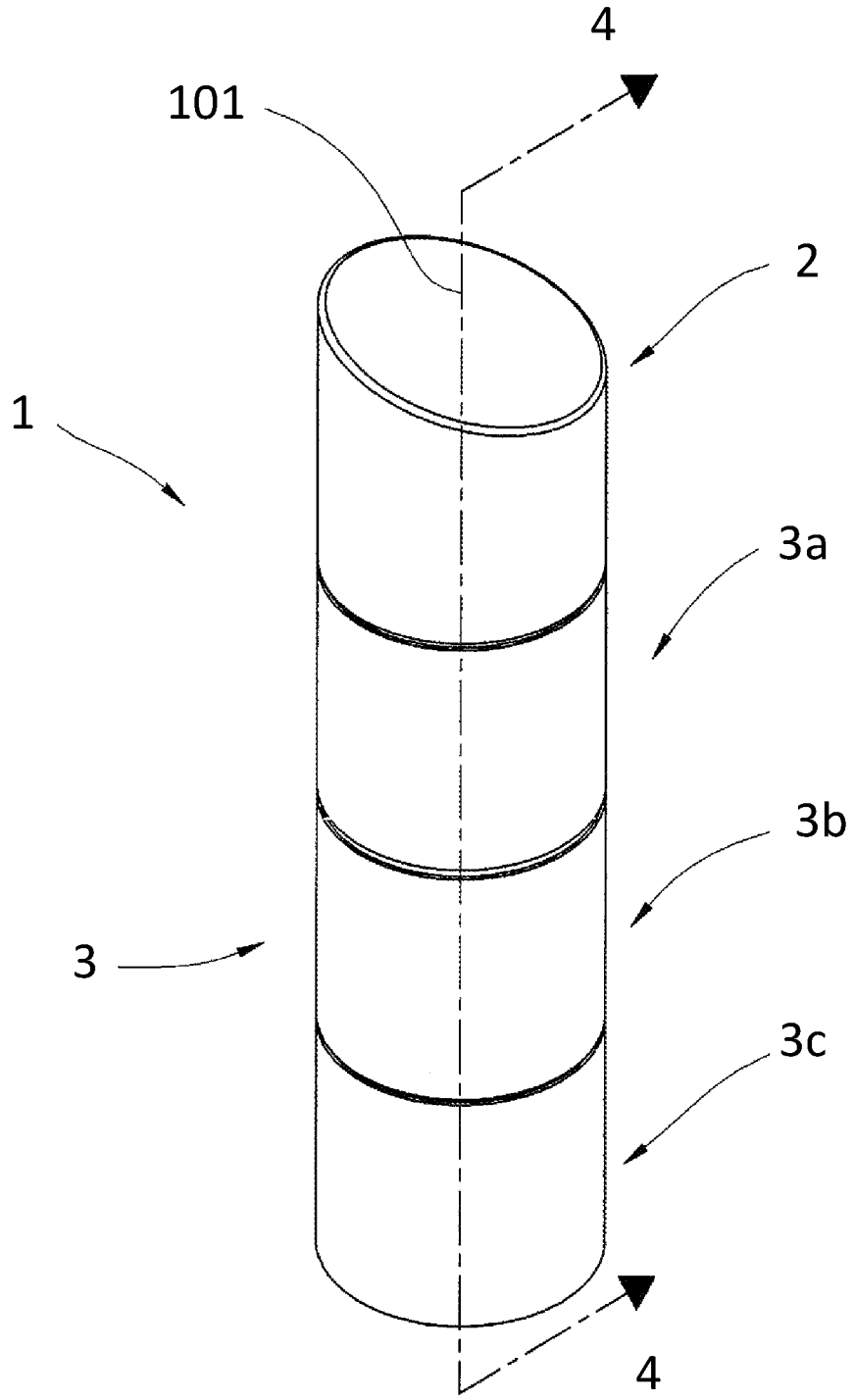
FIG. 1 shows a perspective view of a personal care product applicator having a plurality of cartridge assemblies.

FIG. 1 illustrates a personal care product applicator 1 comprising a plurality of cartridge assemblies 3, including three cartridge assemblies 3*a*, 3*b*, 3*c*, with a removable closure 2. The cartridge assemblies 3*a*, 3*b*, 3*c* are arranged in series along a common axis 101. The three cartridge assemblies 3*a*, 3*b*, 3*c* are secured in series, with the removable closure 2 secured on top of the upper-most cartridge assembly 3*a*. A personal care product applicator 1 can contain fewer (2), or more (4, 5, 6, or more) cartridge assemblies.

Figure 2:
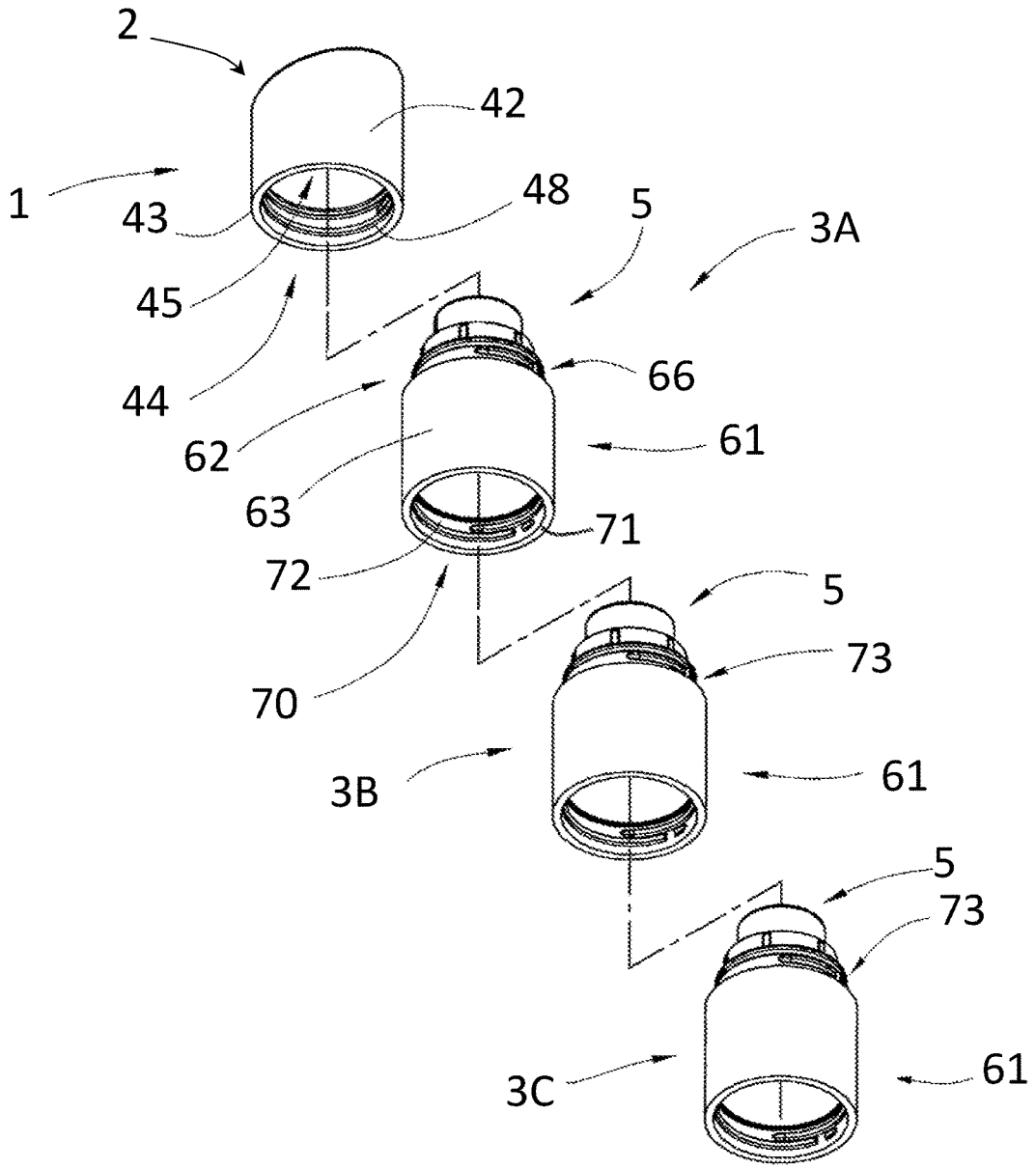
FIG. 2 shows an exploded view of the plurality of cartridge assemblies of the personal care product applicator of FIG. 1.

FIG. 2 illustrates an exploded, bottom perspective view of the personal care product applicator 1. Each cartridge assembly 3*a*, 3*b*, 3*c* includes a product cartridge 5 and a cartridge holder 61 for holding and fixing the product cartridge 5. The closure 2 is configured to be placed on any one of the cartridge holders 61, to cover the product cartridge 5 that is positioned within the top end of each cartridge holder 61. Each cartridge holder 61 includes a lower securement 72 and an upper securement 73. The lower securement 72 of a serially-upper cartridge assembly 3*a*, 3*b* engages with an upper securement 73 of a serially-lower cartridge assembly 3*b*, 3*c*, to serially secure together the cartridge assemblies 3*a*, 3*b*, and 3*c*. Each cartridge holder 61 has a cavity 70 that is accessed through an opening in the bottom, to receive the product cartridge 5 disposed within the top end of a cartridge assembly attached below.

Figure 3:
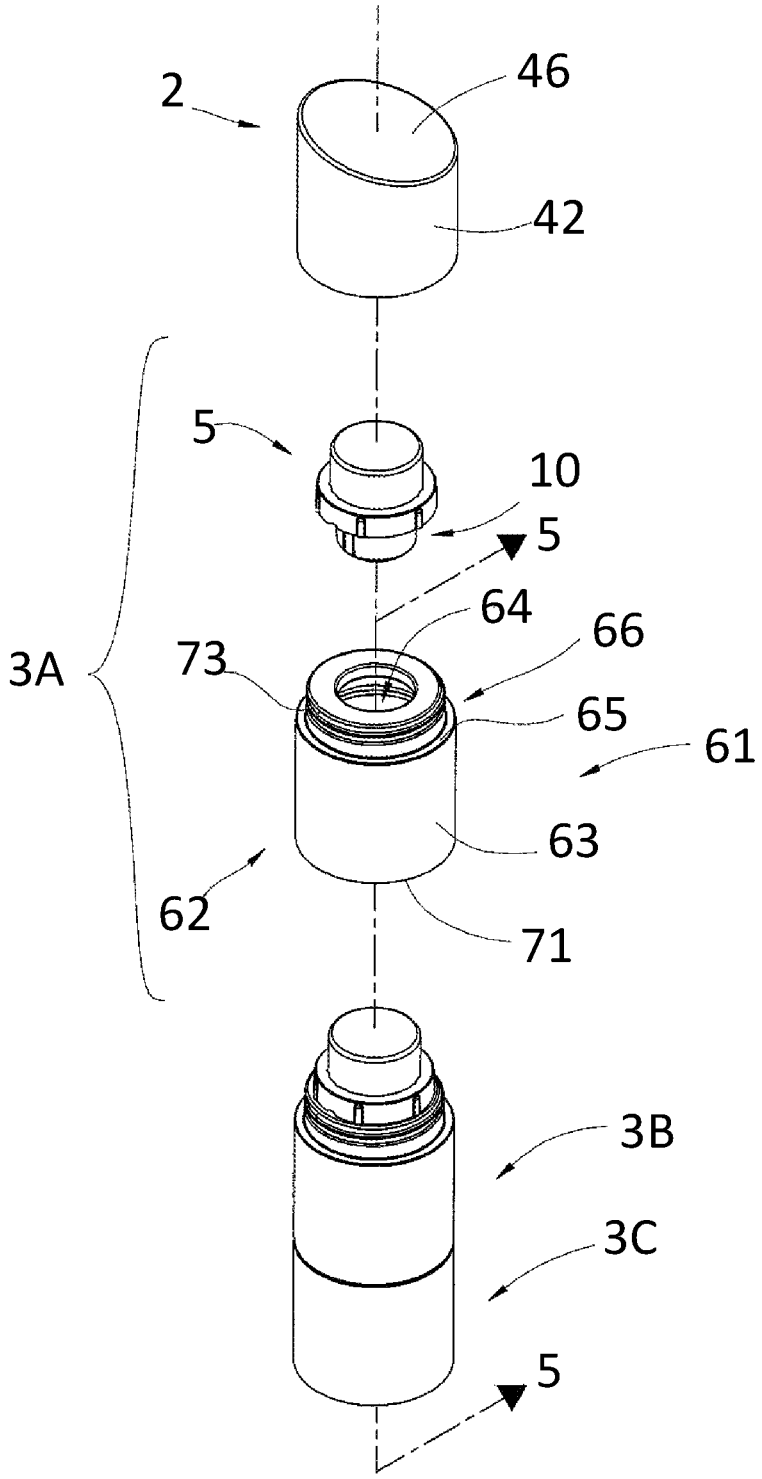
FIG. 3 shows an exploded view of an upper-most cartridge assembly and the removable closure.

FIG. 3 further illustrates an exploded top view of the upper-most cartridge assembly 3*a*. An axial bore 64 can extend into and through the upper segment 73, and intersect the cavity 70. The cartridge holder 61 comprises a body 62 that includes a cylindrical wall 63 of an axial length, and a neck 66 extending from the top 65 of body 62. The cylindrical wall 63 defines the enlarged cavity 70 that extends into the body 62 from the bottom rim 71.

Figure 4:
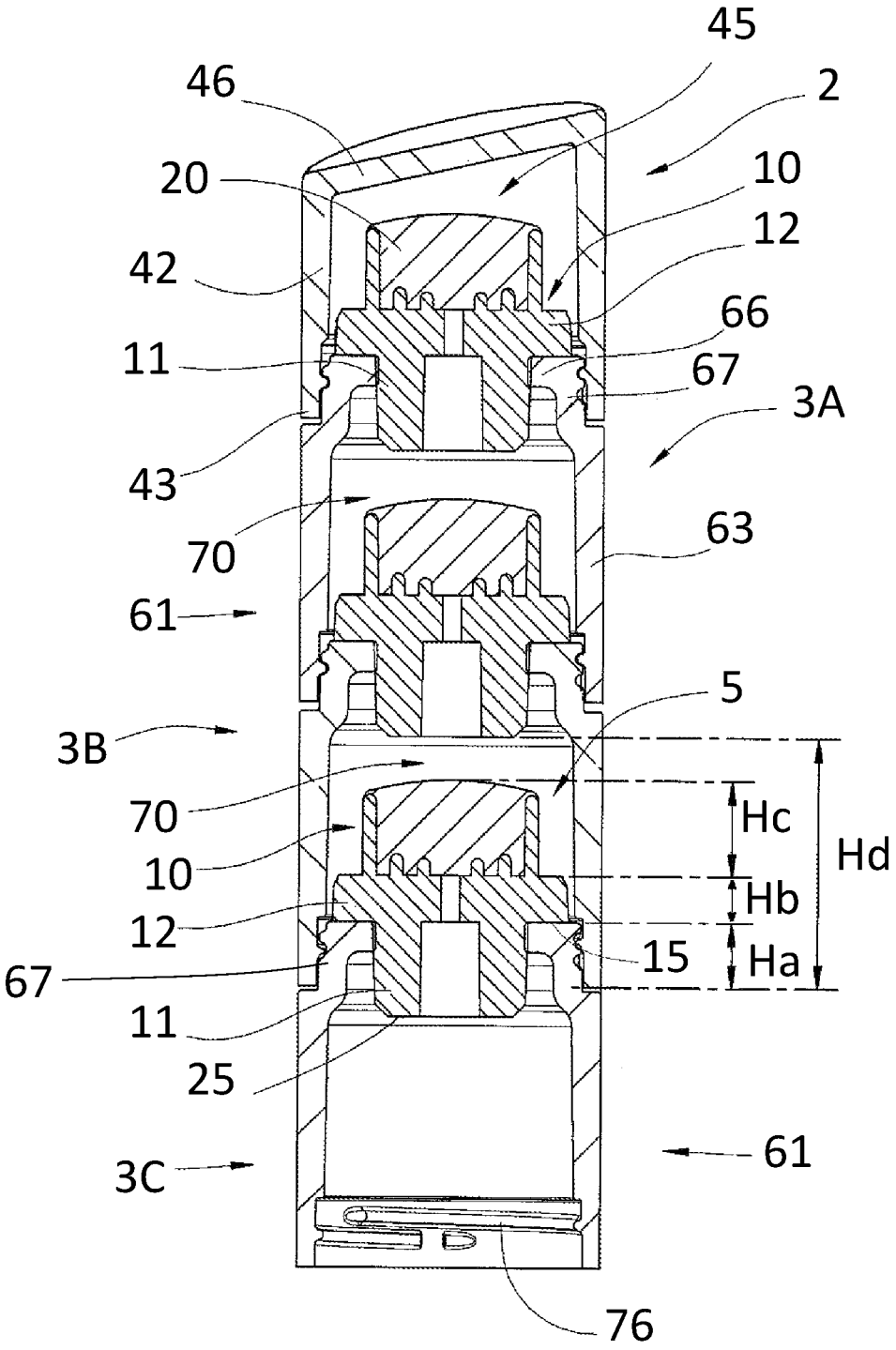
FIG. 4 shows a sectional view of the personal care product applicator viewed through line 4-4 of FIG. 1.
Figure 12:
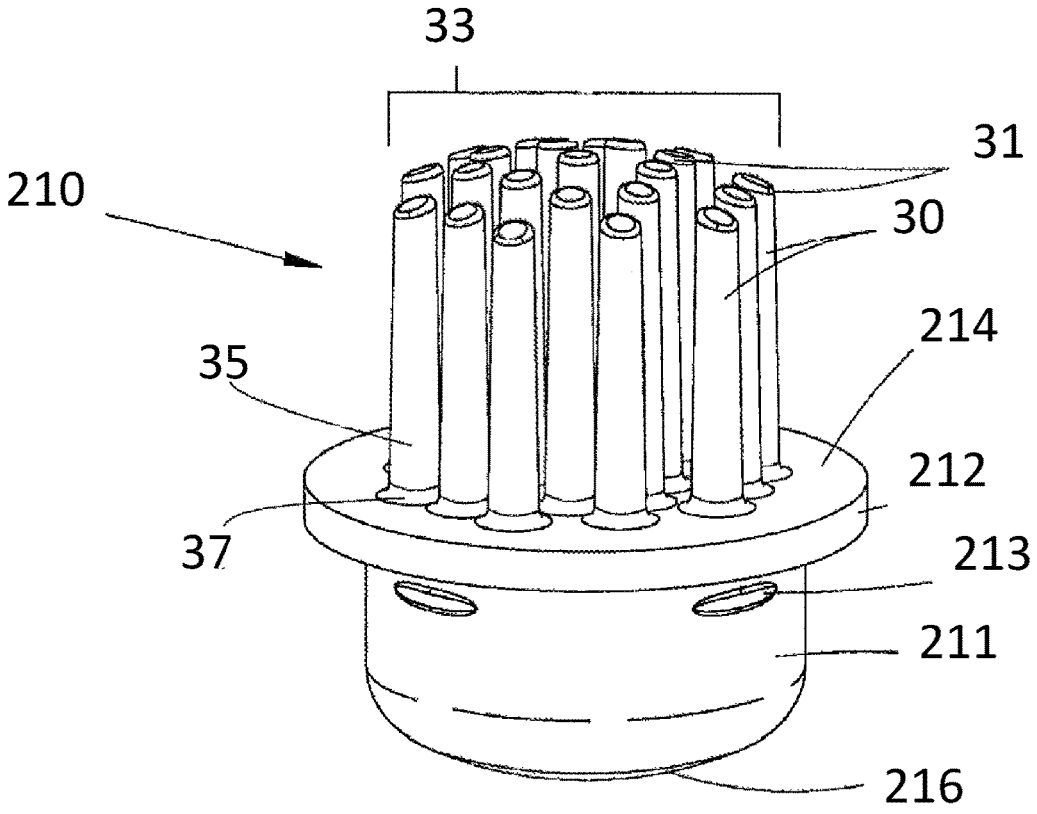
FIG. 12 is a top perspective view of another embodiment of an empty cartridge with a plurality of protuberances integrally attached to the top surface of the cartridge.
Figure 16:
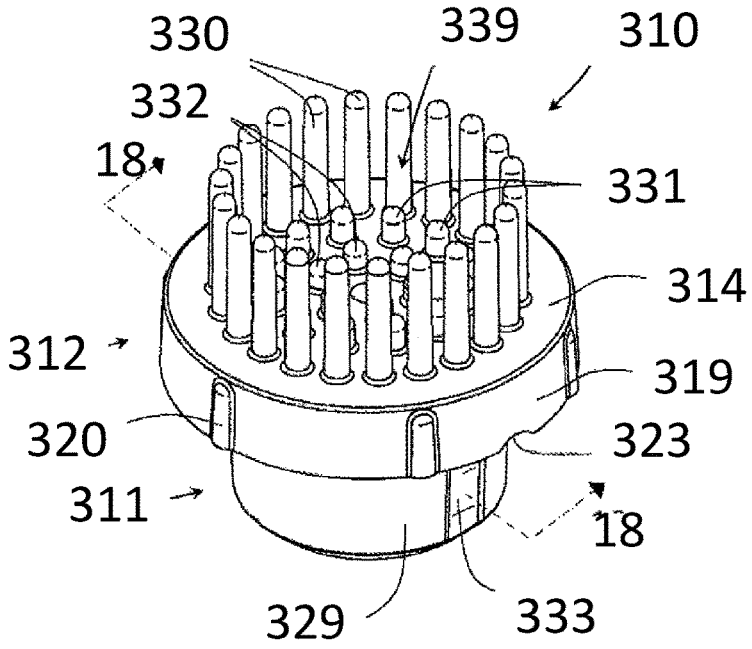
FIG. 16 is a top perspective view of another embodiment of an empty cartridge showing another arrangement of the plurality of protuberances on the top surface of the cartridge

FIG. 4 shows a vertical cross-sectional view through the common axis 101 of the personal care product applicator 1 of FIG. 1. The three cartridge assemblies 3*a*,3*b*,3*c* are identical and can be attached to one another in any series order. Each cartridge assembly 3 comprises a cartridge holder 61 that holds or supports a product cartridge 5. The product cartridge 5 includes a cartridge 10, along with a volume of a composition, and in one embodiment a personal care composition 20, attached and supported to the cartridge 10. In an alternative embodiment, one of the cartridges 10 can contain or have none of the personal care composition, allowing the cartridge to provide an alternative use; for example, a cartridge having a plurality of protuberances as shown in FIG. 12 or FIG. 16 can be used solely for exfoliation of the lips.

Figure 5:
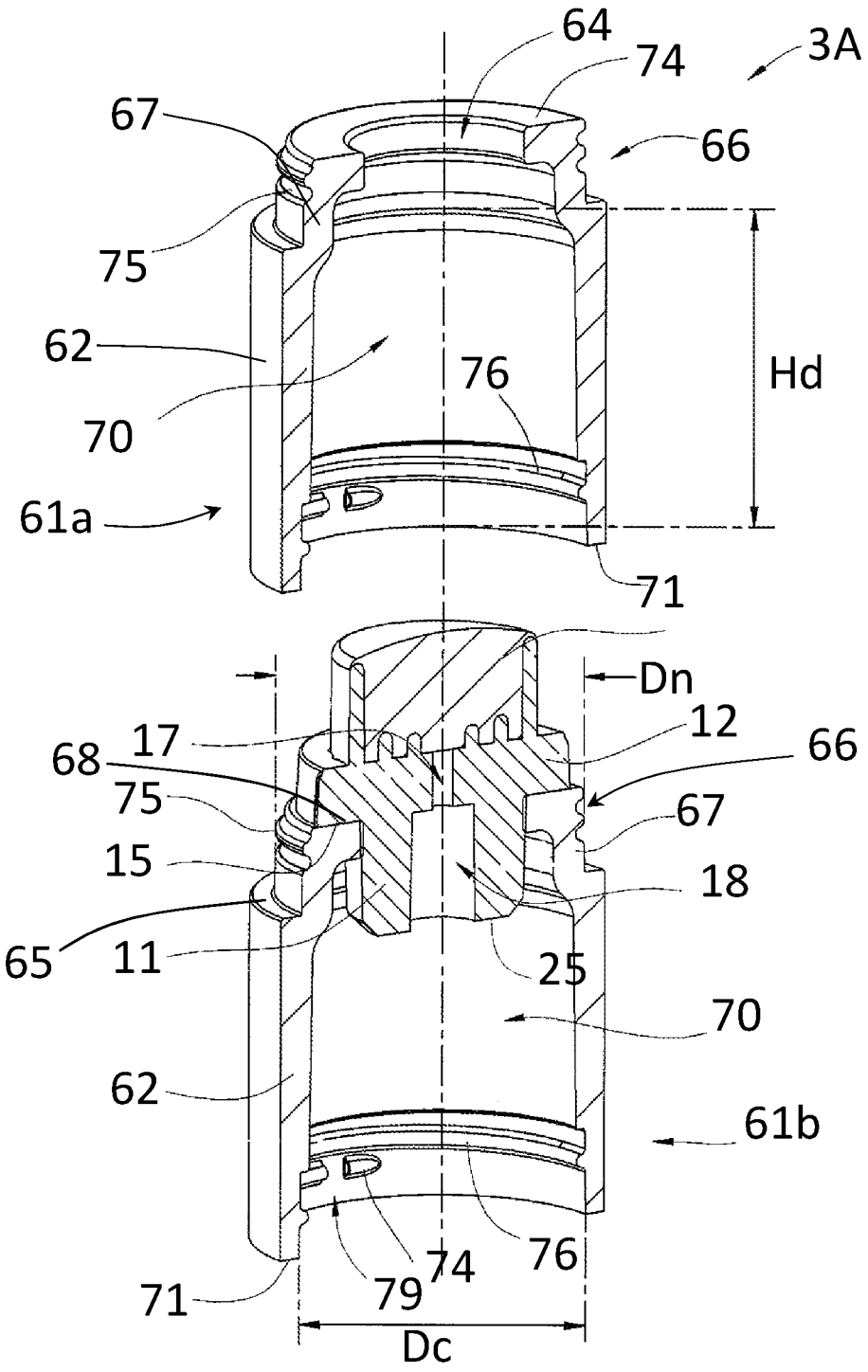
FIG. 5 shows a sectional view of a pair of cartridge assemblies, through line 5-5 of FIG. 3.

FIG. 4 and FIG. 5 further show that the neck 66 includes a cylindrical wall 67 having an upper surface 68, and an attaching means for the cartridge 10, illustrated as an axial bore 64 disposed in the neck 66. In the illustrated embodiment, the axial bore 64 can extend through the neck 66 and communicate into the cavity 70 in the body 62. The cartridge 10 includes a base 12 on which the composition 20 is supported, and a plug 11 extending from the bottom surface 15 of the base 12. When the cartridge 10 is disposed and secured within the cartridge holder 61, the plug 11 is fully inserted within the bore 64 of the neck 66, and the under-surface 15 of the base 12 of the cartridge 10 is confronting and in contact with the upper surface 68 of the neck 66.

The body of the cartridge holder 61 includes an annular outer wall 63 that defines the main cavity 70 within, and the neck 66 extending from the top end 65 of the body, with the bore 64 extending though the neck 66 for receiving and securing the plug 11 the product cartridge 5. The cavity 70 can be a cylindrical space or a tapering cylindrical space.

In an alternative embodiment, the attaching means can include a threaded bore, which engages a corresponding thread on the plug, for threading the cartridge to the cartridge holder. In another embodiment, the attaching means can include an adhesive material that is applied between the plug of the cartridge and the bore of the cartridge holder, for permanently securing the cartridge within the cartridge holder.

As shown in FIGS. 4 and 5, the cavity 70 is sufficient in height Hd so as to receive a portion of the height Ha of the neck 66 of the serially-lower cartridge holder 61, as well as the height Hb of the base 12 and the height Hc of the volume of personal care composition 20 of the product cartridge 5 disposed within the neck 66 of the serially-lower cartridge holder. The neck 66 of the cartridge holder 61, for example cartridge holder 61*b*, has a diameter Dn, and is insertable by threading within a diameter Dc of the cavity 70 of a serially-upper cartridge holder 61, for example, cartridge holder 61*a*. A cartridge holder 61 has outer-projecting threads 75 on the neck 66, which threadedly engage inwardly-facing threads 76 at the bottom rim 71 of a serially-upper cartridge holder 61, to draw the neck 66 of the serially-lower the cartridge holder into the cavity 70 of the serially-upper cartridge holder.

Figure 7:
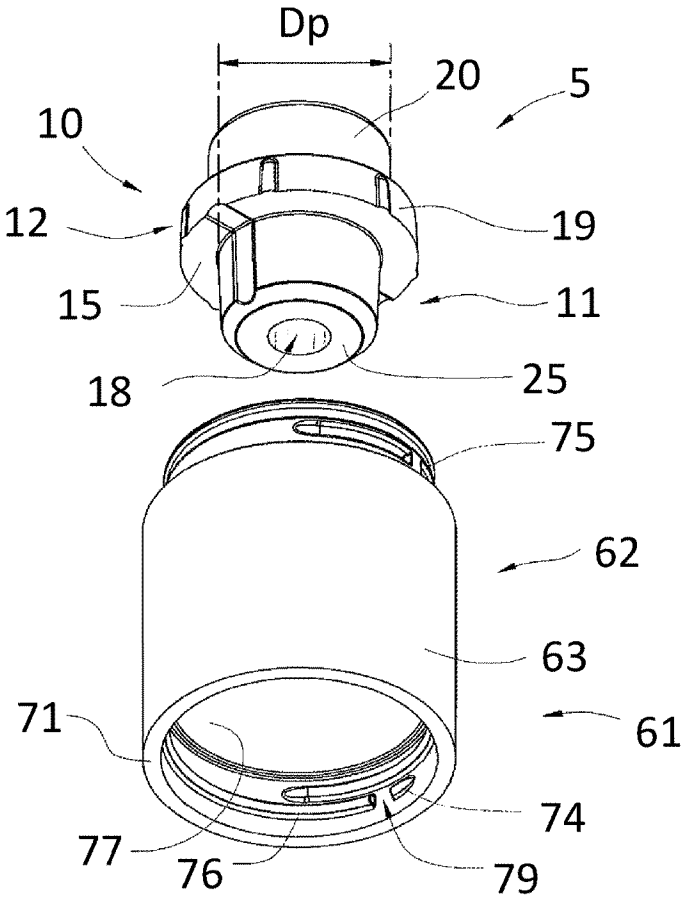
FIG. 6 and FIG. 7 show a top perspective view and a bottom perspective view, respectively, of a cartridge assembly.
Figure 6:
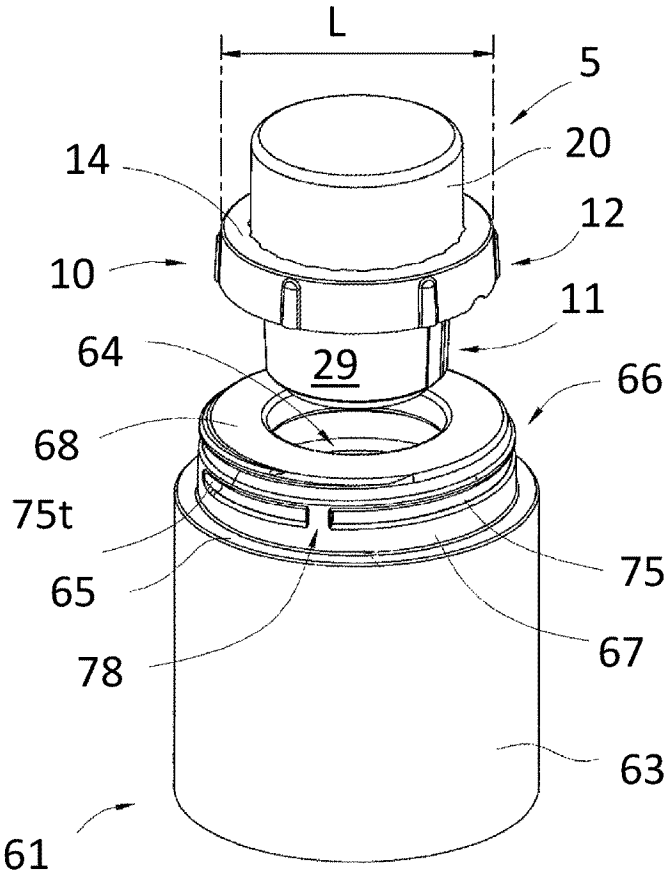

FIG. 6 and FIG. 7 further illustrate the cartridge assembly 3, including the cartridge holder 61 and the product cartridge 5. The cartridge holder 61 comprises the helical thread 75 on the outer surface of the cylindrical wall 67 of the neck 66, that consist of inwardly-protruding threads or thread segments, having a suitable concave cross-sectional shape; for example, an elliptical, trapezoidal or circular shape. The cartridge holder 61 also includes the helical thread 76 on an interior surface 77 of the cylindrical wall 62, that consist of outwardly-projecting grooves or thread segments having a convex cross-sectional shape; for example, U-shaped, V-shaped or bevel shaped, that mate with the helical thread 75. Two separate cartridge holders 61 such as shown in FIG. 5, can be brought to an axially and serially-arranged position, with the lower helical thread 76 of the upper cartridge holder 61*a* in an unthreaded position into touching but unthreaded engagement with the upper helical thread 75 on the neck 66 of the lower cartridge holder 61*b*. From the unthreaded position, the upper cartridge holder 61*a* can be rotated with respect to the lower cartridge holder 61*b*, so that the helical thread 76 and helical thread 75 engage and draw the respective cartridge holder 61 to a secured position, as shown, for example, in FIG. 4.

Figure 8:
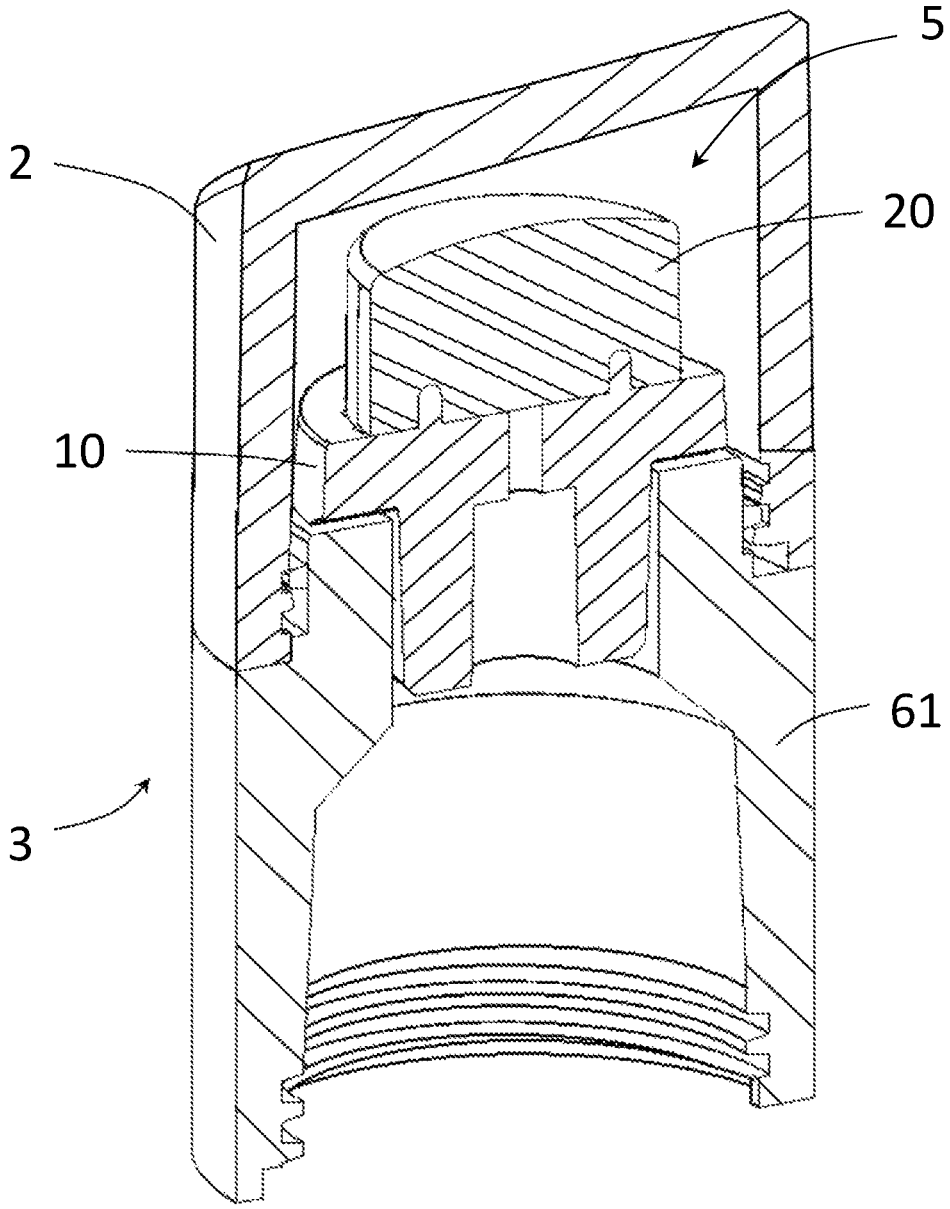
FIG. 8 illustrates a cross section of a single-cartridge cartridge assembly, including a single cartridge holder and a single product cartridge, with the removable closure.

FIG. 8 illustrates a cross section of a single-cartridge cartridge assembly 3, including a single cartridge holder 61 and a single product cartridge 5 having a base 10 with a product composition 20, with a removable closure 2.

The cartridge holder 61 also includes a first locking member that is disposed proximate the top, for example, proximate the helical male thread 75, and a second locking member that is disposed proximate the bottom, for example, proximate the helical female thread 76. When the two cartridge holders 61*a* and 61*b* have been rotated to the secured position, the first locking member engages the second locking member, to lock the two cartridge holders, at the secured position. A non-limiting example of a mating or matching pair of first locking member and second locking member include a detent and a locking protrusion. In one embodiment, the detent is positioned on or formed into the base of the neck 66, and the second locking member can be positioned on or formed into the lower rim 71.

In one embodiment, the first and second locking members are formed from or associated with the mating helical thread 75 and 76. As shown inn FIG. 6 and FIG. 7, the thread 75 in the neck 66 is formed into the wall portion 67 of the neck 66, forming the thread 75 that is a helical void in the wall 67. A barrier segment 78 spaced angularly from the terminating end 75*t* of the inwardly-protruding thread 75, and fills-in a portion or segment of the inwardly-protruding thread 75. The barrier segment 78 has a top surface that is formed by the outer surface of, and is flush with, the cylindrical wall 67 of the neck 66, and has a length (along the thread 75) that extends a distance about the same as the width of the thread 75.

The mating thread 76 at the lower end 71 of the holder 61 is a helical thread that extends outwardly away from the inner surface of the wall 62. The outwardly-projecting thread 76 includes a leading thread segment 74 that is separated by a gap 79 from the remaining portion of the thread 76. The length of the gap 79 (along the thread 76) is at least a long, and preferably slightly longer, than the length of the barrier segment 78 in the inwardly-projecting thread 75. After the tapered leading edge of the leading thread segment 74 has been threaded over and past the barrier segment 78, the length of the gap 79 of the thread 76 is sufficient to capture and retain the barrier segment 78 of the thread 75. To move the barrier segment 78 from the gaps 79 when unthreading, some additional unthreading force is required to cause the barrier segment 78 to climb out of the gap 79 and descend from the leading thread segment 74, thereby provide a locking element to lock the threaded parts together and prevent them from unthreading spontaneously or accidently.

A removable closure 2 can be secured on top of the upper-most cartridge assembly 3*a*. As shown in FIGS. 2-4, the removable closure 2 comprises a top wall 46 defining a closed end, an annular side wall 42 defining a cavity 45, and a bottom annular rim 43 that defines a bottom opening 44 into the cavity 45. The removable closure 2 includes a securement, comprising inwardly-facing threads 48 (FIG. 2) disposed along the bottom rim 43 of the closure 2, to engage the threads 75 on the upper-most cartridge holder 61. The threads 48 can be the same as the threads 76 of the cartridge holder 61. The removable closure 2 protects the volume of personal care composition 20 on the product cartridge 5 of the upper-most cartridge assembly 3*a* from the external environment. The removable closure 2 can also include a means for locking with a cartridge holder 61 when threadedly closed, employing a same or similar locking member or means as described herein for the locking together of the cartridge holders 61.

The volume of personal care composition 20 that is placed on the top surface 74 of the base 12 can be an external-use composition that is a solid, a semi-solid, a gel, or a wax. Non-limiting examples of the composition can include a cosmetic, therapeutic, hygienic, or skin-care composition, including such non-limiting examples as lip balm, lip gloss, lipstick, mascara, foundation, concealers, blemish removers, creams, aloes, lotions, ointments, make-up blush, eye shadow, sunscreen, gels and lotions infused with any one or more of a perfume, fragrance, scent, and essential oil, and deodorants. In an alternative embodiment, the composition can be a home or personal use composition, such as, by non-limiting example, a cooking or baking grease, a detergent composition, a shoe polish. Non-limiting examples of personal care compositions are described in U.S. Pat. No. 9,004,791, the disclosure of which is incorporated by reference in its entirety. In a specific embodiment of the invention, the personal care composition is lip balm. Non-limiting examples of lip balm compositions can contain beeswax or carnauba wax, camphor, cetyl alcohol, lanolin, paraffin, and petrolatum, among other ingredients.

As shown in the FIG. 2, the removable closure 2 placed on the upper-most cartridge assembly 3*a* can be removed when the volume of personal care composition 20 is to be applied to the lips or skin of the user, or when one or more of the cartridge assemblies needs to be removed, rearranged, or discarded. Once the volume of personal care composition 20 of the upper-most cartridge assembly 3*a* is exhausted, the removable closure 2 is unthreaded and removed. The upper-most cartridge assembly 3*a* can be removed and/or discarded. When the upper-most cartridge assembly 3*a* is discarded, the removable closure 2 can be attached to the new serially-upper cartridge assembly 3*b*. The position of any of the cartridge assemblies 3 can be re-arranged as desired by the user, by un-threading one or more of the cartridge assemblies from the stack, re-positioning, and re-threading them.

The cartridge 10 includes a rigid or resilient upper base 12 having a top surface that is flat, planar, or convex. A volume of personal care composition is applied and attached to the top surface of the upper base. The cartridge can include a means for mechanically or frictionally securing the cartridge releasably into a cartridge holder of the personal care product applicator container.

Figure 9:
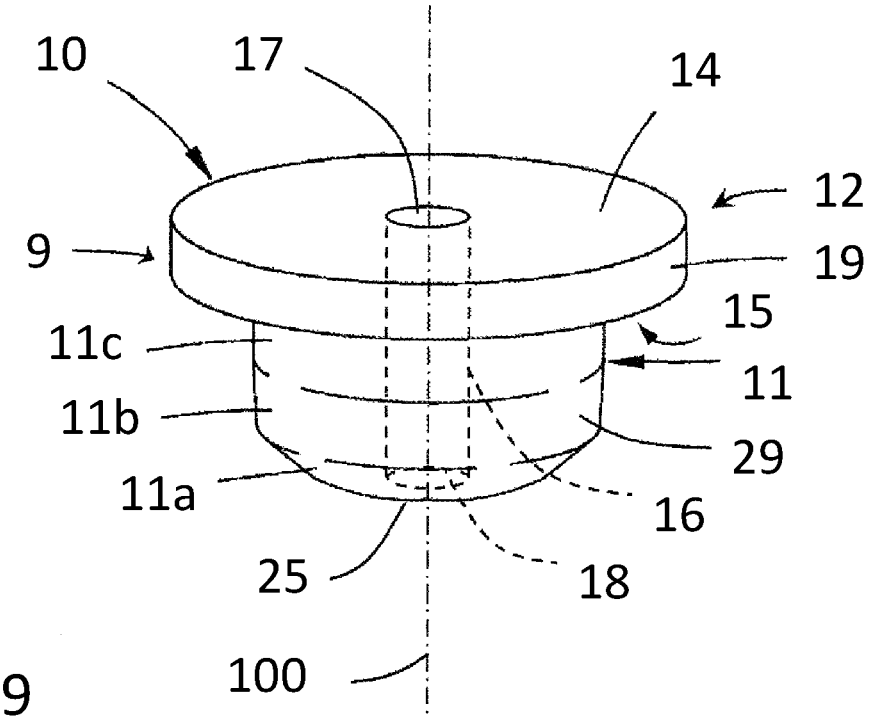
FIG. 9 is a top perspective view of a cartridge including an upper base that has a flat top surface.

FIG. 9 illustrates an empty cartridge 10 (a cartridge without the personal care composition) including a body 9 that includes an upper base 12 that has an outer sidewall 19 and a flat top surface 14. The body includes a plug 11 having an outer sidewall 29 that extends perpendicular from the underside 15 of to the upper base 12. The plug 11 can also be configured into two or more segments 11*a*, 11*b*, and 11*c* that taper inward to facilitate a frictional fit inside the receptacle of an applicator container. The outer sidewall 29 can have an annular shape. In most embodiments, the cross sectional shape of the plug 11 matches or is complimentary to the shape of the bore 64 formed into the neck 66 of the cartridge holder 61.

In an embodiment of the cartridge 10, the body illustrated in FIG. 9 has a bore 16 formed axially into the plug 11. The bore 16 can be a cylindrical bore, and can extend along the centerline axis of the body. The bore 16 can extend through a bottom surface 25 of, and into, the plug 11 to define an opening 18. A distal end of the bore 16 can extend beyond the plug 11 and into the upper base 12. In the illustrated embodiment, the bore 16 can extend through the top surface 14 of the upper base 12 to define an opening 17 in the top surface 14 of the upper base 12. The bore 16 can provide a pathway through, and fluid communication between, the top surface 14 of the upper base 12, and the under surface 25 of the plug 11.

The upper base and the plug of the cartridge can be made of any rigid or resilient material, including but not limited to metallic or thermoplastic materials, or inert synthetic polymers, such as polysiloxane, which is commonly referred to as silicone.

In another embodiment of the invention, the bore 16 can be positioned radially away from the centerline axis 100 of the plug and upper base 12, while in another embodiment, there can be two or more bores, spaced apart along the top surface 14 of the upper base 12. The bore 16 is typically slightly tapered along its axial length, inwardly and away from the bottom 25, to aid in the molding process.

In one aspect of the invention, the bore 16 provides a cavity into which the surrounding material of the plug 11 can expand elastically when the plug 11 is being pressed into a capturing bore 64 of the cartridge holder, as described herein before. Preferably, the cross-sectional size of the bore 16 is sufficient to permit the elastic compression of the material of the plug 11. In another embodiment illustrated in FIG. 16, the portion of the bore 316 through the upper base 12 can be a different size or diameter than that of the portion of the bore 326 through the plug 11, and in one such embodiment, the diameter or size of the bore 316 through the upper base 12 is smaller, and preferably about half, or less, the diameter or size of the bore 326 through the plug 11.

Figure 10:
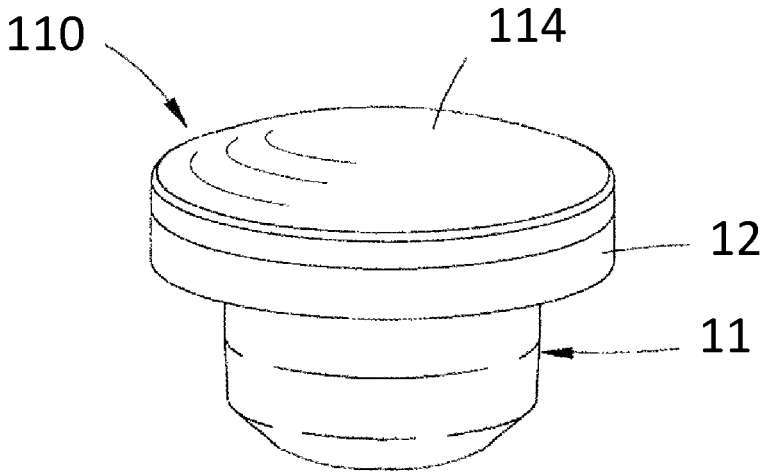
FIG. 10 is a top perspective view of another embodiment of a cartridge including an upper base that has a convex top surface.

The bore 16 in the cartridge body 9 also can serve as a vent for the escape of any air or gases that might become trapped near the top surface 14 of the upper base 12 when the volume of personal care composition is placed onto the top surface 14. In such embodiment, the bore 16 extends from the opening 17 in the top surface 14 to the opening 18 in the bottom or under surface 25 of the plug. This can improve the consistency and effectiveness of the personal care composition mounted onto the cartridge. Preferably, the cross-sectional size of the bore(s) 16 is sufficient to permit any air or gas to vent from under the personal care composition during application of the composition to the top surface 14 of the upper base 12. In an alternative embodiment, as illustrated in FIG. 10, a cartridge 110 can include a body that includes a plug 11 and an upper base 12 that has a convex top surface 114.

In another embodiment, the top surface of the upper base can be planar. Configuring the top surface of the upper base to be flat, convex, or planar can enable the user to access and apply the entire volume of the personal care composition that is attached to the cartridge by wiping the surface of the base across the lips, skin, or other body part. In some embodiments, the top surface 14 or 114 is essentially circular, as shown in FIGS. 9 and 10. However, the top surface of the cartridge configured into any shape to facilitate the loading of the cartridge inside an applicator container or the application of a personal care product.

Figure 11:
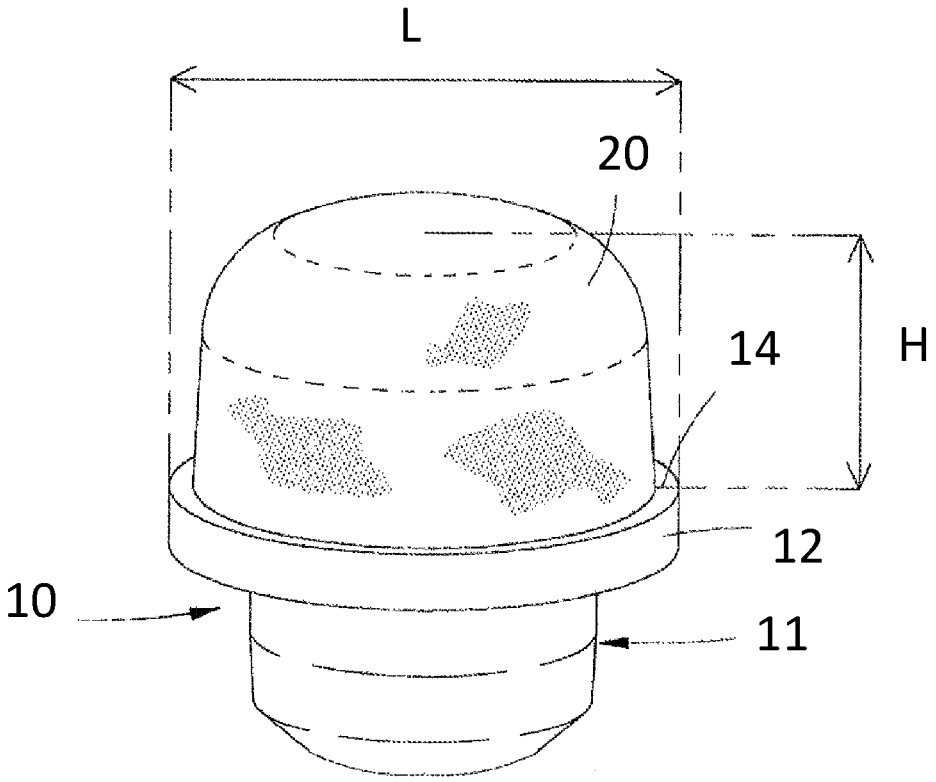
FIG. 11 is a top perspective view of the cartridge in FIG. 9 with a personal care composition attached to the flat top surface.

FIG. 11 illustrates a cartridge 10 that includes a volume of a personal care composition 20 attached to an upper base 12 that has a flat top surface 14. Limiting the height Hc of the personal care composition 20 to be shallow relative to the size of the cartridge 10 can additionally reduce the amount of the composition used per cartridge and promote its limited use. The height Hc of the volume of personal care composition 20 can be less than or equal to the maximum length L of the top surface 14, where the height of the personal care composition 20 is measured from the uppermost surface of the cartridge base 12. The height 'He of the personal care composition 20 on the cartridge 10 is approximately one half of the maximum length 1' (diameter) of the flat top surface 14. However, as one skilled in the art would appreciate that the height Hc and the length L can be varied accordingly. The cartridge 10 can be defined having a vertical center axis, and in some embodiments, the cartridge base 12, the top surface 14, and the personal care composition 20, can be coaxial with one another. In another embodiment, the entire cartridge, including the personal care composition, can be symmetrical around the vertical center axis.

The cartridge can be secured inside a cartridge holder by any mechanical means known in the art. Non-limiting examples of mechanical means that can be used to secure the cartridge include a snap bead and snap detent mechanism. In one embodiment, as shown in FIG. 12, a plurality of snap beads 213 disposed intermittently around the periphery of the wall of the plug 211. The mechanical means can also include a slide and track mechanism; a finger latch mechanism; a mounting post and receiving slot mechanism; complimentary screw threads; a lever and catch; a twist lock closure; a pair of magnets of opposite polarity; a hook material and a loop material; snap beads and snap detents; kiss locks; a snap stud and snap socket; or a buckle and a clasp.

FIGS. 12-15 illustrate a cartridge 210 with a plurality of protuberances 30 integrally attached to a flat top surface 214 of the upper base 212. The protuberances can be typically elongated, and/or extend normal to the top surface, and/or extending in parallel to one another. In some embodiments, the protuberances extend parallel to the common axis shared by the body and top surface of the cartridge. The protuberances 30 can be made by molding and can comprise the same material as the base, including but not limited to resilient materials such as thermoplastic materials or inert synthetic polymers. In some embodiments of the invention, the protuberances can be made of polysiloxane, commonly referred to as silicone.

In another embodiment of the invention, the plurality of cartridges, including the protuberances, can be made of a colored material, including but not limited to colored polysiloxane, to improve the aesthetics of the product cartridges, or to provide a flavor or scent signal for the personal product composition contained on the cartridge.

Protuberances of different lengths can be utilized so the distal ends 31 of each of the plurality of protuberances 30 provide a shaped contact surface 33 with which the user can exfoliate his or her lips or skin during use. The contact surface 33 can be configured into any desired shape from which to exfoliate the lips or skin during application of the personal care composition 20, including but not limited to a domed surface, a flat surface, an angled surface, or any other desired shape. The protuberances can have an aspect ratio (a length to width ratio) of between 5:1 to 9:1.

The cartridge 10 can also include any number of protuberances 30 in any desired pattern or arrangement to provide a combination of anchoring of the personal care or personal use composition 20 onto the cartridge along with exfoliation performance. Additionally, arrangements of protuberances can include protuberances that have a different length, diameter, or durometer than other protuberances in the same arrangement. Protuberances may also be arranged so that some protuberances in the arrangement are tightly packed together while other protuberances are comparatively spaced further apart. A personal care composition that is gel-based or loosely-packed can be attached to a cartridge that includes several protuberances that have a smaller diameter and are tightly arranged. Conversely, solid, waxy, or tightly-packed personal care compositions that can maintain their own shape can be utilized on cartridges that include protuberances that are spaced further apart or have thicker diameters, or on cartridges that do not include protuberances at all. Non-limiting examples of arrangements of protuberances on the top surface include tightly-packed protuberances in rows, concentric circles, or other patterns.

In some embodiments of the invention, the personal care composition can be embedded between the plurality of protuberances, anchoring the personal care composition to the cartridge. To more effectively anchor the personal care composition, the length, diameter, firmness, and shape of the protuberances can be tailored by one skilled in the art based on the type and characteristic of the personal care composition. A protuberance can have a length of about 1 to about 15 millimeters, particularly about 3 to about 10 millimeters, and a diameter or longest cross-sectional dimension of about 0.5 to about 5 millimeters, particularly about 1 to about 3 millimeters. A protuberance material can have a durometer on the Shore A scale of about 10 to about 70, particularly a durometer on the Shore A scale of about 25 to about 40. The protuberances can be sufficiently firm and resilient to retain their shape when the lip balm is loaded and embedded around the bristles, to retain their shape as the lip balm is applied, and to exfoliate the user's skin or lips when the personal care composition, for example a lip balm, is applied and depleted. The protuberances should be pliable and not overly elastic such that they collapse or lay over onto the surface of a remaining portion of the personal care composition embedded between them as the composition is depleted. The cross-sectional shape of a protuberance can be circular, oval, square, rectangular, other polygon, or any effective shape. Additionally, the protuberances themselves can also be formed into any desired shape or type, including but not limited to blades, bristles, nubs, or nodules. In some embodiments of the invention, the plurality of protuberances comprises a plurality of silicone bristles.

The protuberances 30 have a number of physical and material properties, and can be used in a variety of arrangements, to provide value and benefits to the user of the product. The plurality of protuberances can have a rounded, preferably smooth, distal end 31. In one embodiment, the spacing between the distal ends of adjacent protuberances is at least one protuberance-end diameter, which in one embodiment can range between about 25-40 mil (0.025-0.040 inches), and in another embodiment, about 30 mil (0.030 inches). Each of the bristles or protuberances 30 has a cylindrical outer shape, tapering slightly (about 5 degrees) outwardly from the distal end 31 to the base end 35 (see FIG. 12), which is attached integrally to the top surface 14 of the upper base 12 through a transition base 37.

In one embodiment of the invention, the density of protuberances or bristles on the top surface of the upper base is at least 10 bristles, and particularly at least 20 bristles, per square cm, and up to about 60 bristles per square cm, including about 35-45 bristles per square cm.

In an embodiment of the invention, the length of a protuberance, from the top surface of the upper base, to the distal end of the protuberance, can be at least 100 mil (0.10 inch, 2.5 mm), including at least 150 mil (0.15 inch, 3.8 mm), and up to longer lengths, for example, 1 inch (25.4 mm), and can include 180 mil (0.18 inch, 4.5 mm), 190 mil (0.19 inch, 4.75 mm), and 200 mil (0.20 inch, 5 mm).

In an embodiment of the invention, the volume of the personal care composition is typically about 0.25-10 ml, and in some embodiments about 0.5-1.0 ml. In an embodiment of the invention, the ratio of the volume of the personal care composition to the volume of the plurality of protuberances 30 is typically at least 4:1, and up to about 20:1, which can include at least 5:1, or 6:1, or 7:1, or 10:1. In another embodiment, the ratio of the total area that boundaries the plurality of protuberances to the total area of the plurality of base ends of the protuberances, is typically at least 3:1, and up to about 10:1, which can include at least 4:1, such as about 5:1, or about 6:1.

Figure 14:
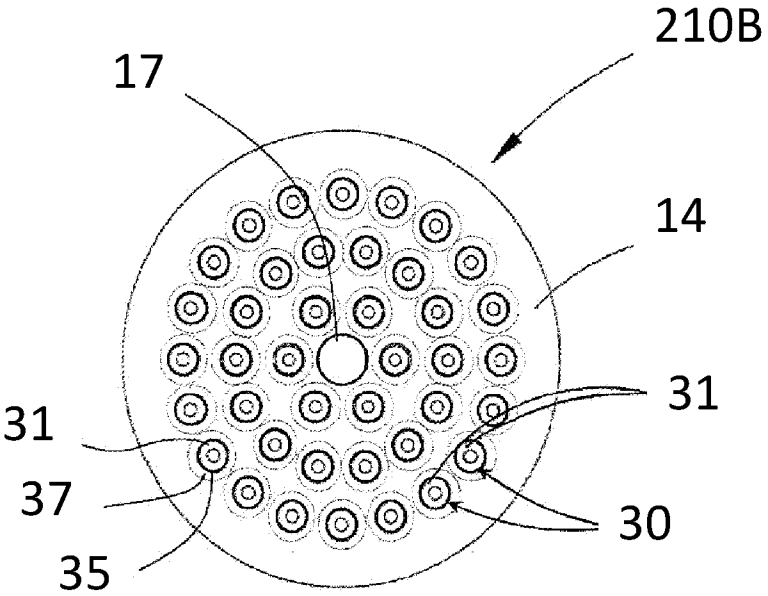
FIG. 14 is a top plan view of an alternate arrangement of the plurality of protuberances on the top surface of a cartridge.
Figure 13:
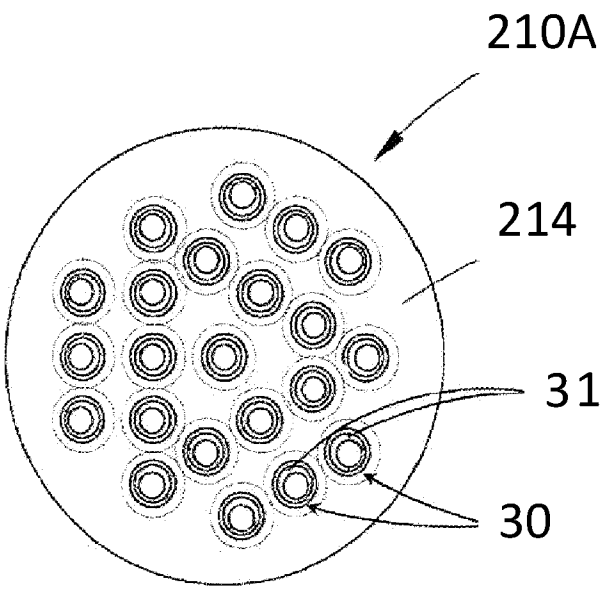
FIG. 13 is a top plan view taken of the empty cartridge in FIG. 12 showing an arrangement of the plurality of protuberances on the top surface of the cartridge.
Figure 15:
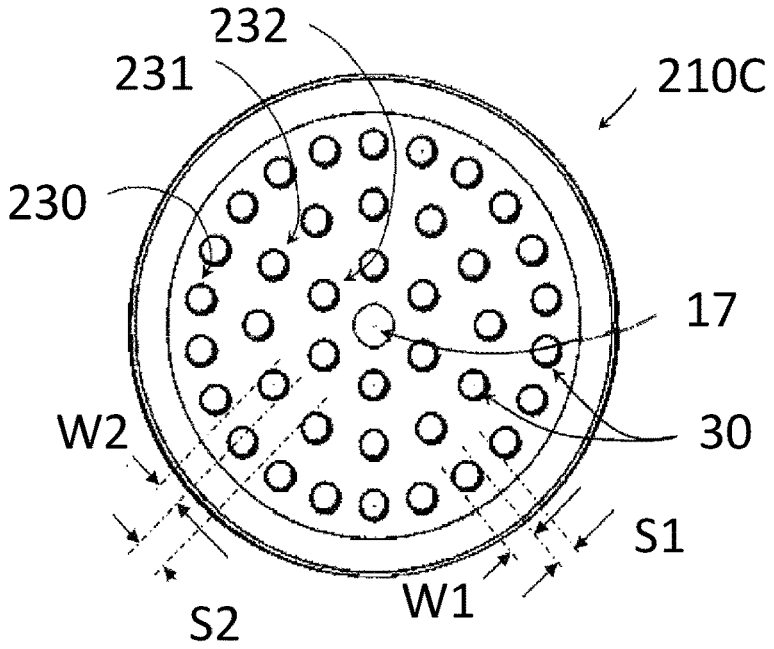
FIG. 15 is a top plan view of a further alternate arrangement of the plurality of protuberances on the top surface of a cartridge.

As illustrated in FIG. 13, the plurality of protuberances 30 can be arranged in a manner that they form the shape of a triangle, with additional protuberances 30 filling in gaps on the flat top surface 214 of cartridge 210A. In contrast, FIG. 14 shows a cartridge 210B having an alternate arrangement of protuberances 30 in a series of concentric circles. FIG. 15 shows a cartridge 210C having another alternate arrangement of protuberances 30 including an outer-most ring 230 of protuberance 30 that have a tighter packing of protuberances 30 in comparison to the intermediate ring 231 and the inner-most ring 232 of protuberances 30. As shown, the width $w_1$ of the protuberances 30 in the outer-most ring 230 is about the same as the spacing Si between adjacent protuberances 30 in the outer-most ring 230. The ratio of the protuberances width $w_1$ to the spacing $s_1$ is typically about 1.0±0.2, and alternatively about 1.0 or greater. In comparison, the width $w_2$ of the protuberances 30 in the intermediate ring 231, or the inner-most ring 232, is less than the spacing Ω between adjacent protuberances 30 in the intermediate ring 231, or the inner-most ring 232. The ratio of the protuberances width $w_2$ to the spacing $s_2$ is less than the ratio for the outer-most ring 230, and is typically less than 1.0. Without being bound by any particular theory, the more densely packed protuberances in the outer-most ring 230 provide a more robust barrier, or dike or dam, against the flow laterally of the composition 20 through the outer-most ring 230, which helps to control against excessive and unwanted leakage of the composition 20 from the cartridge.

Figure 18:
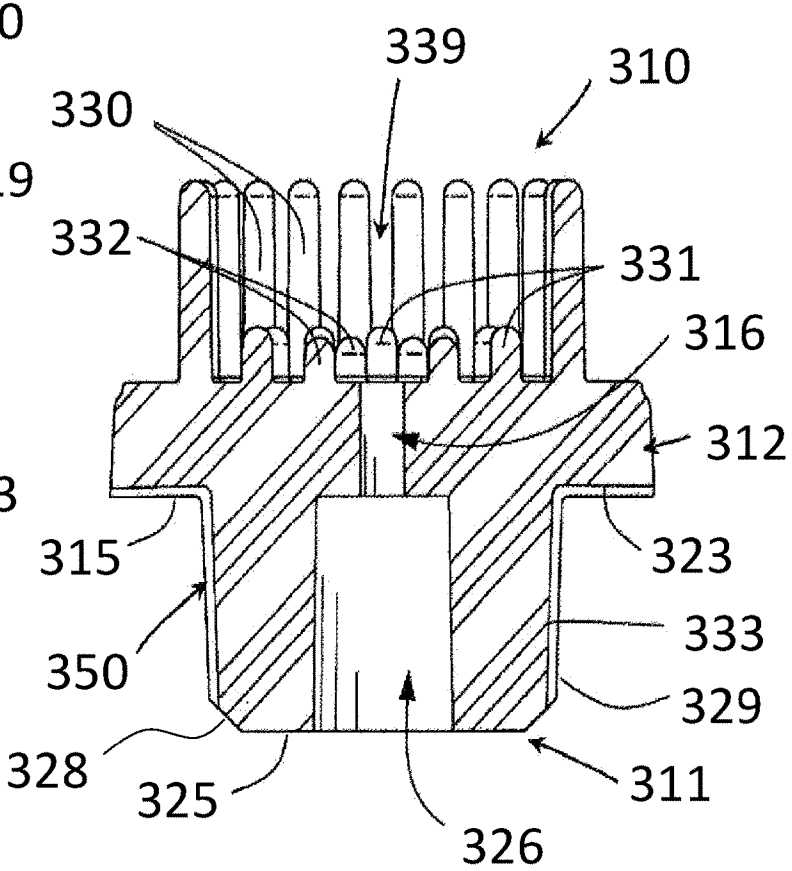
FIG. 18 is a sectional view of the empty cartridge of FIG. 16, taken along lines 18-18.
Figure 17:
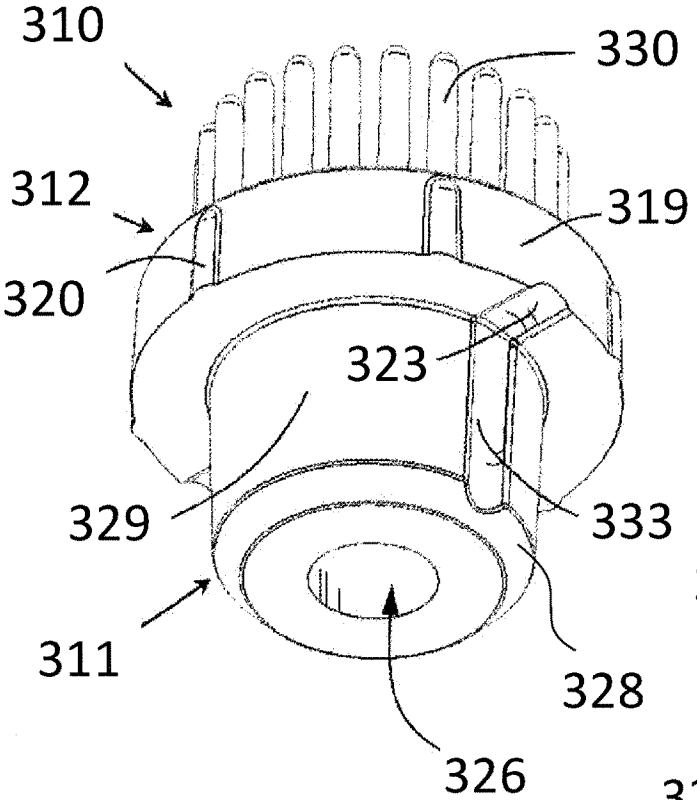
FIG. 17 is a bottom perspective view of the empty cartridge of FIG. 16.

FIGS. 16, 17 and 18 illustrate another embodiment of a cartridge 310. The cartridge 310 as illustrated includes an upper base 312 that has a flat top surface 314, and a plug 311 and that extends perpendicular to, and from an undersurface 315 of, the upper base 312 in a direction opposite the protuberances. The top surface 314 of the upper base 312 supports a plurality of protuberances or bristles, including at least one outer ring of protuberances 330. Inboard of the at least one outer ring of protuberances 330 defines a center portion of the top surface 314. The protuberances also include an inner group or ring of shorter protuberances 332 that are disposed within the center portion of the top surface 314. The shorter protuberances 332 can have a shorter length relative to the longer protuberances 330, and typically less than 50%, and more particularly less than 25%, the length of the longer protuberances 330. Optionally, the plurality of protuberances can include intermediate protuberances 331, which have a length shorter than the longer protuberances 330, and can have a shorter, though more typically longer, length than the shorter protuberances 332. In the particular illustrated embodiment, the shorter protuberances 332 have an aspect ratio of about 1:1, the intermediate protuberances 331 have an aspect ratio of about 2:1, and the outer protuberances 330 have an aspect ratio of about 6:1. At least 50% of the protuberances have an aspect ratio of about 6:1.

The first, longer protuberances 330 define an open cavity 339 having an area bounded by the longer protuberances 330, and occupying a space above the top surface 314, the shorter protuberances 332, and the intermediate protuberances 331. The reduced length of the shorter protuberances 332 and/or intermediate protuberances 331 provide a greater volume within the open cavity 339 for the personal care composition, while having a length sufficient to provide anchoring of the personal care composition deposited into the open cavity 339. The length of the shorter protuberances 331 and/or 332 may also be sufficient to contribute to the exfoliation performance of the cartridge.

The upper base 312 has a through bore 316, while the plug 311 has a through bore 326 in fluid communication with the bore 316 of the upper base 312, where the through bore 326 is at least twice the diameter or size of that of the bore 316. The plug 311 has an outer sidewall 329 that has a taper 328 at a bottom surface 325.

In an embodiment of the invention, the plug 311 has one or more axially-extending grooves 333 formed into the outer sidewall 329, from proximate the bottom 325 of the plug 311, to the juncture of the plug 311 with the upper base 312. The groove 333 aids in venting air that might be trapped within a capturing bore 64 of a cartridge holder 61, which otherwise becomes compressed and resists insertion of the plug of the cartridge into the receptacle. The air escapes from within the receptacle along the groove 333 as the plug 311 descends into the receptacle. In yet another embodiment, the upper base 312 has a broad radially-extending groove 323 formed into the under surface 315, extending from the juncture of the plug 311 with the upper base 312, to the outer sidewall 319 of the upper base 312. The radial groove 323 can intersect and join with the axial groove 333 to provide a unitary channel 350 that provides fluid communication from the bottom 325 of the plug 311 to the sidewall 319 of the upper base 312. These features can aid in the venting of air that might be trapped within a capturing bore 64 of a receptacle 61, which otherwise becomes compressed and resists insertion of the plug of the cartridge into the receptacle. In the illustrated embodiment, there are two opposed vent channels 350, each consisting of the axial groove 333 and the radial groove 323, on opposite lateral sides of the plug 311, although other number and arrangements of vent channels, and vent channels of other cross-sectional shapes, surfaces and depths, can be used.

In an alternative embodiment, a capturing bore of a cartridge holder can be provided with one or more similar vent grooves along the interior sidewall and upper rim of the receptacle, to define a vent channel in the bore.

In another embodiment of the invention, the upper base 312 can include one or more ribs or raised members 320 disposed on the outer sidewall 319, typically distributed around the periphery or circumference. The ribs or raised members 320 can provide a grasping point for gripping and rotating the cartridge 310, for example, to rotate the cartridge 310 when removing it from a receptacle.

It should be appreciated by those skilled in the art that the example depicted in FIGS. 13 through 18 are non-limiting illustrations only, and that the protuberances may be arranged on the top surface of the cartridge base in any pattern, arrangement, number, length, shape, durometer, or diameter desired or necessary to anchor a particular personal care composition to the cartridge.

In one example of the cartridge of the invention, the top surface 14 of the upper base 12 has a diameter of 0.55 inch, and the plurality or matrix of bristles has total diameter of about 0.45 inches, and a uniform height of about 0.20 inches.

Although the above examples illustrate cartridges with protuberances integrally attached to a flat top surface of the base, protuberances can additionally be attached to cartridges with top surfaces that are convex, planar, or concave. As with cartridges having a flat top surface, the lengths of each of the plurality of protuberances on a convex top surface can be identical to each other to form a domed contact surface, similar to that shown in FIG. 12. Similarly, a plurality of identical-length protuberances on a concave top surface can form a recessed contact surface. Additionally, the lengths of each of the plurality of protuberances can be appropriately varied on convex or concave top surfaces to provide a flat contact surface, or the lengths can be otherwise varied to create any desired arrangement and layout of the protuberances on the top surface of the cartridge base.

Figure 19:
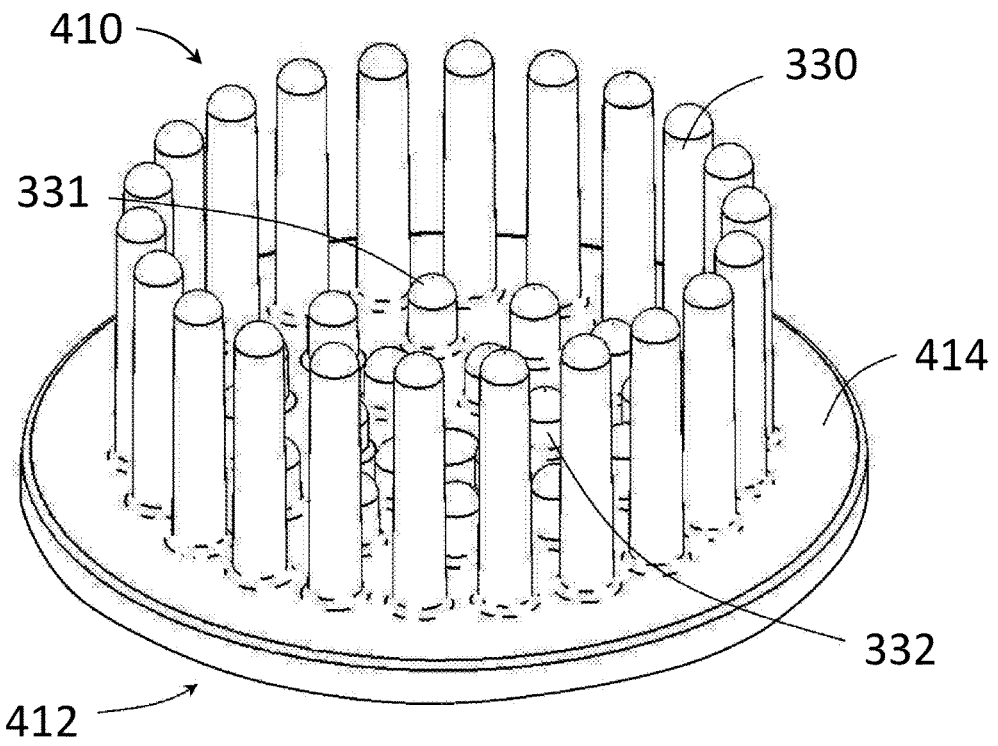
FIG. 19 illustrates an embodiment of a plurality of protuberances formed integrally to a sheet of flexible or resilient material.

In another embodiment, illustrated as by a protuberance sheet 410 in FIG. 19, the plurality of protuberances, such as the protuberances 330, 331 and 332 shown in FIG. 16, can be formed integrally to an upper surface 414 of a sheet 412 of flexible or resilient material, the protuberances extending normally to the plane of the sheet 412, which can be then applied and affixed securely to an upper surface of an upper base of a separate cartridge, described and illustrated herein. The material of the protuberance sheet 410 can include a resilient material, including but not limited to thermoplastic materials, or inert synthetic polymers, such as polysiloxane, which is commonly referred to as silicone.

In some embodiments of the invention, the cartridge may additionally include a removable or discardable covering which envelops to protect the personal care composition and keep it sanitary either prior to loading the cartridge into an applicator container or prior to the first application of the personal care composition on the lips or skin of the user. The discardable covering may be configured to any shape necessary to prevent the personal care composition from contacting any surfaces outside of the cartridge, including the applicator container in which the cartridge is loaded, and may include adhesives to ensure a proper seal with the cartridge. The sanitary covering may additionally include a tab or another means known to those skilled in the art to facilitate removal of the sanitary covering from the cartridge. The discardable covering can be a rigid or resilient cap. The cap includes an annular rib that can form a snap fit with a corresponding annular groove on the cartridge base. However, the cap can be configured to be releasably fastened to the cartridge base by any means known in the art. Additional non-limiting examples of caps can envelop or encapsulate the personal care composition. In some embodiments, the protecting wrap is shrink wrap. Any of the caps or protecting wraps may be discarded after initially being removed from the cartridge, or they can be reinstalled after each application to provide an additional layer of protection for the personal care composition when not in use. A cap can be formed out of metallic, thermoplastic, or silicone-based materials. In some embodiments, the cap is plastic.

While the present invention has been illustrated by the description of embodiments and examples thereof, it is not intended to restrict or in any way limit the scope of the appended claims to such detail. Additional advantages and modifications of the details of the invention will be readily apparent to those skilled in the art. Accordingly, departures may be made from such details without departing from the scope of the invention.

I claim:

1. A personal care product applicator comprises a plurality of cartridge assemblies arranged in series along a common axis, wherein each cartridge assembly includes a cartridge holder comprising a body that includes a cylindrical wall with an axial length, an axial bore in an upper surface proximate a top of the body, and an upper securement and a lower securement, for securing the plurality of cartridge assemblies in series; and a product cartridge including:

(i) a cartridge that comprises a base and a plug that includes a cylindrical wall having an axial length with a bottom surface, which extends from a lower surface of the base, the plug configured for inserting into the axial bore for attaching the product cartridge to an attaching means of the cartridge holder; and (ii) a volume of a personal care composition disposed to an upper surface of the base.

2. The personal care product applicator of claim 1, wherein the body of the cartridge holder has an enlarged cavity extending into the body from a bottom edge of the body, the enlarged cavity sized sufficiently to receive a serially-lower cartridge assembly, including the product cartridge comprising the base and the volume of the personal care composition.

3. The personal care product applicator of claim 1, the cartridge holder further comprising a neck extending from the top of the cartridge holder, the neck comprising a cylindrical wall having an upper surface that defines the upper surface proximate the top of the body having the axial bore, wherein the axial bore is formed in the neck and extends axially into the body.

4. The personal care product applicator of claim 3, wherein a lower securement of a serially-upper cartridge assembly engages an upper securement of a serially-lower cartridge assembly, and the serially-upper cartridge assembly is movable rotationally relative to the serially-lower cartridge assembly between a secured position where the serially-upper cartridge assembly and the serially-lower cartridge assembly are fixed together, and an unsecured, unthreaded position where the serially-upper cartridge assembly and the serially-lower cartridge assembly can be axially separated.

5. The personal care product applicator of claim 4, wherein the upper securement comprises a helical thread on an outside of the cylindrical wall of the neck and wherein the lower securement comprises a helical thread on an interior surface proximate a lower edge of the cylindrical wall of the cartridge holder, which threadedly mates with the helical thread of the neck.

6. The personal care product applicator of claim 5, wherein the lower edge of the cylindrical wall of a serially upper cartridge assembly overlaps the neck.

7. The personal care product applicator of claim 5, wherein the cartridge holder has a first locking member proximate the top of the cartridge holder, and a second locking member proximate the bottom of the cartridge holder and where the first locking member of the serially-lower cartridge assembly engages the second locking member of the serially-upper cartridge assembly to lock the serially-upper cartridge assembly and the serially-lower cartridge assembly at the secured position.

8. The personal care product applicator of claim 7, wherein the first locking member comprises a barrier segment spaced proximate a terminating end of a first inwardly-protruding thread, and the second locking member comprises a second outwardly projecting thread including a leading thread segment that is followed by a gap that is sufficient to capture and retain the barrier segment when the first thread is threaded to a closed position with the second thread.

9. The personal care product applicator of claim 3, wherein the lower surface of the base of the cartridge confronts and is in contact with the neck of the cartridge holder.

10. The personal care product applicator of claim 1, wherein the base and the plug of the cartridge have a cylindrical bore extending axially there through, serving as a vent between the upper surface of the base and the bottom surface of the plug.

11. The personal care product applicator of claim 10, wherein the personal care composition is a solid, a semi-solid, a gel, or a wax.

12. The personal care product applicator of claim 11, wherein the personal care composition is gel or wax, selected from the group consisting of a lip gloss, lip balm, lipstick, and mascara.

13. The personal care product applicator of claim 12, wherein the personal care composition is infused with one or more of a perfume, a fragrance, a scent, an essential oil, and a deodorant.

14. The personal care product applicator of claim 1 also includes a removable closure on an uppermost cartridge assembly.

15. The personal care product applicator of claim 1, wherein the lower surface of the base of the cartridge confronts and is in contact with the upper surface proximate the top of the body of the cartridge holder.

16. The personal care product applicator of claim 15, wherein the upper surface of the base of the cartridge is disposed above the upper surface of the cartridge holder.

17. The personal care product applicator of claim 1, wherein the cartridge further comprises a plurality of protuberances integrally attached to and extending upwardly from the upper surface of the base of the cartridge, and the volume of personal care composition is embedded between the plurality of protuberances.

18. The personal care product applicator of claim 1, wherein the cartridge holder further comprises a neck extending from the top of the cartridge holder, the neck comprising a cylindrical wall having an upper surface that defines the upper surface proximate the top of the body having the axial bore, and wherein the enlarged cavity of the body of the cartridge holder of a cartridge assembly is sized sufficiently to receive both a portion of the neck of the cartridge holder and the product cartridge of a serially-lower cartridge assembly.

19. The personal care product applicator of claim 1, wherein plug is configured to facilitate a frictional fit inside the axial bore of the cartridge holder.

20. The person care product applicator of claim 1, wherein the attaching means is the axial bore of the cartridge holder.

* * * * *